United States Patent [19]

Mayer et al.

[11] 3,933,351

[45] Jan. 20, 1976

[54] SHEET DELIVERY ARRANGEMENT HAVING AN AIR-STREAM SHEET RETARDER

[75] Inventors: Peter Mayer, Mulheim; Siegfried Schuhmann, Offenbach, both of Germany

[73] Assignee: Roland Offsetmaschinenfabrik Faber & Schleicher AG, Germany

[22] Filed: Nov. 22, 1974

[21] Appl. No.: 526,156

[30] Foreign Application Priority Data

Nov. 22, 1973 Germany ..... 2358206

[52] U.S. Cl. ..... 271/183; 271/204

[51] Int. Cl.[2] ..... B65H 29/68

[58] Field of Search ..... 271/183, 182, 202, 231, 271/204, 205, 206, 195

[56] References Cited

UNITED STATES PATENTS 3,779,545 12/1973 Schuhmann et al. ..... 271/183

FOREIGN PATENTS OR APPLICATIONS 769,979 3/1957 United Kingdom ..... 271/183

*Primary Examiner*—John J. Love
*Assistant Examiner*—Bruce H. Stoner, Jr.
*Attorney, Agent, or Firm*—Wolfe, Hubbard, Leydig, Voit & Osann, Ltd.

[57] ABSTRACT

A delivery arrangement including a conveyor and take-off mechanism for delivering a series of printed sheets onto a pile in which nozzles are provided distributed along the width of a sheet, for directing a jet of air to the underside in a direction opposite the sheet movement. A guide plate spaced under the sheet and extending upstream from the nozzles serves to confine the jet. Formed on the surface of the guide plate are a plurality of upraised islands, spaced from one another over the area of the guide plate, the islands presenting plateau surfaces at approximately the same elevation above the guide plate. Consequently, when a sheet is sucked downwardly by the jet of air it engages the plateau surfaces in light frictional engagement to apply frictional drag to the body of the sheet. The source of pressurized air for the nozzles includes means for automatically varying the pressure, and hence the frictional drag, in accordance with the speed of the press. In a preferred embodiment the plateau surfaces, which are spaced both laterally and longitudinally of the guide plate, occupy less than half of the total area of the guide plate and at least a portion of the guide plate is formed with a gradual curvature in a direction downwardly away from the sheet.

7 Claims, 7 Drawing Figures fig. 7.
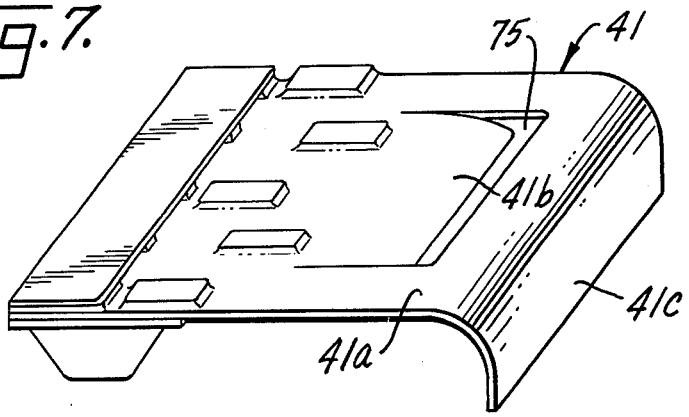
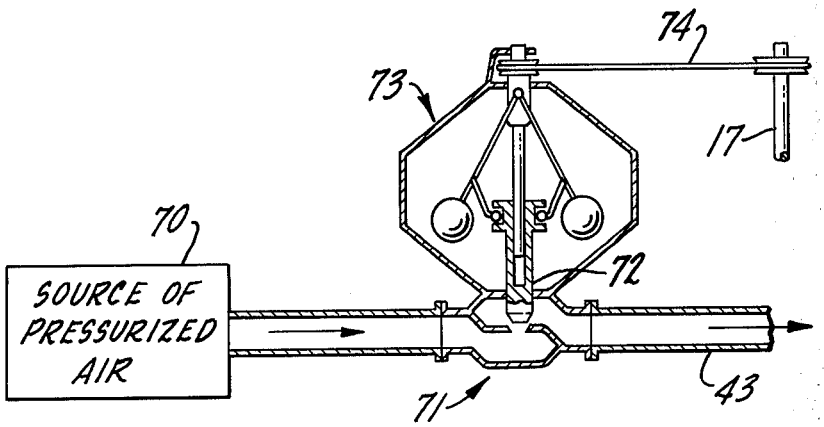
fig. 6.

SHEET DELIVERY ARRANGEMENT HAVING AN AIR-STREAM SHEET RETARDER

In prior U.S. Pat. No. 3,779,545 which issued Dec. 18, 1973 to one of the present co-inventors, means including a wide nozzle and guide plate are provided for inhibiting fluttering of a conveyed sheet and for decelerating it prior to depositing upon a delivery pile. It has been found that anti-flutter and deceleration may be more efficiently achieved by forming the surface of the guide plate with a plurality of upraised islands spaced from one another over the area of the guide plate, and with the islands presenting plateau surfaces at approximately the same elevation above the guide plate.

It is, accordingly, the object of the present invention to provide improved means for controlling and declerating a sheet, which provides optimum and consistent deceleration and which more completely overcomes any tendency toward fluttering and whipping in the air stream. It is a related object to provide a delivery arrangement for a printing press which is capable of operating at a higher speed than earlier devices intended for the same purpose and in which the deceleration characteristics are varied automatically in accordance with changes in press speed.

Other objects and advantages of the invention will become apparent upon reading the attached detailed description and upon reference to the drawings in which:

FIG. 6 shows means for varying air pressure in accordance with press speed.

FIG. 7 is a perspective view of a modified form of the assembly shown in FIG. 2.

Figure 1:
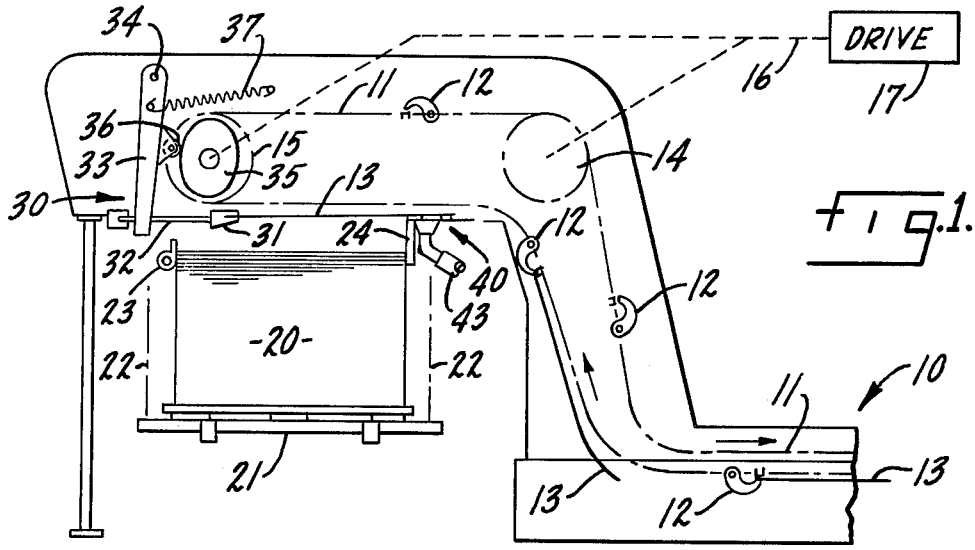
FIG. 1 is a diagrammatic side elevational view of a delivery arrangement employing the present invention.
Figure 2:
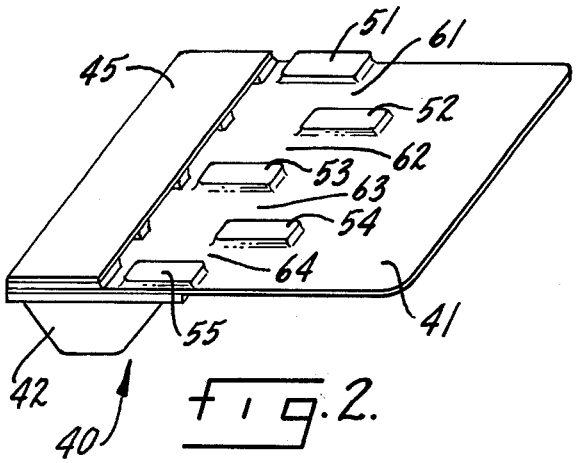
FIG. 2 is a perspective view showing the nozzle and guide plate assembly of FIG. 1 in enlarged form.

While the invention has been described in connection with certain preferred embodiments, it will be understood that we do not intend to be limited to the particular embodiments shown, but intend, on the contrary, to cover the various alternative and equivalent constructions included within the spirit and scope of the appended claims.

Turning now to the drawings there is shown a delivery arrangement 10 having an endless chain 11 which is indicated by the dot-dash line and which carries a series of grippers 12 for gripping a series of transported sheets 13. The chain is trained around rollers or sprockets 14, 15 which are driven at "press" speed via a connection 16 from the press drive 17. Sheets 13 may be printed on either one or both sides in the associated lithographic printing press (not shown).

The purpose of the conveyor is to convey sheets to a position above a delivery pile 20 where the sheets are supported on a platform 21 which is suspended upon chains diagrammatically indicated at 22 for progressive sinking movement as sheets are added to the top of the pile. To form a straight stack, a series of "front" guide members 23 are provided at the left-hand side of the pile and a series of "rear" guide members 24 are provided along the right-hand side of the pile. The means for maintaining the top of the pile at a constant level by gradual lowering of the platform 21 does not form a part of the present invention and for details of the automatic level adjusting mechanism cross reference is made, for example, to U.S. Pat. No. 2,262,236.

For removing the successive sheets from the conveyor, for decelerating them, and for depositing them on the pile 20, a take-off mechanism 30 is provided. The take-off mechanism does not per se form a part of the present invention, and any suitable take-off mechanism, synchronized with the arrival of the sheets, may be used, for example, that illustrated in U.S. application Ser. No. 448,629 filed Mar. 6, 1974, now U.S. Pat. No. 3,900,193. Referring to the take-off mechanism 30 shown diagrammatically in FIG. 1, it includes grippers 31 mounted upon a reciprocated member 32 which is reciprocated by an arm 33 pivoted at 34. For oscillating the arm 33 a cam 35 is provided mounted upon the shaft of the member 15 and having a cam follower 36 in the form of a roller secured to the arm. The cam follower is maintained in contact with the cam by means of a tension spring 37. Means (not shown) are provided for releasing the grippers 12 on the conveyor chain so that the leading edge of the sheet may be gripped by the grippers 31 which rapidly decelerate the sheet so that the leading edge is reduced to zero velocity by the time the leading edge arrives at the "front" pile guides 23, at which time the grippers 31 are released to allow the sheet to settle onto the top of the pile.

Figure 3:
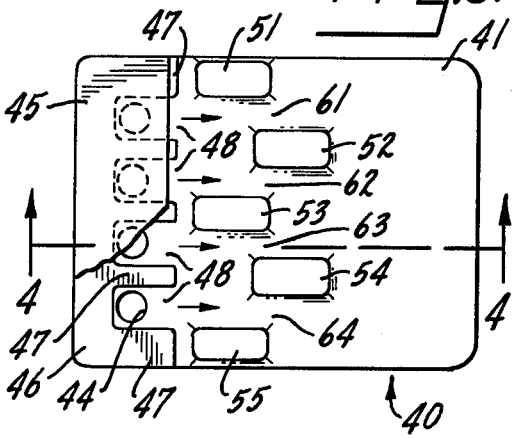
FIG. 3 is a plan view, in partial section, of the assembly shown in FIG. 2.

For the purpose of acting upon the underside of a sheet, a nozzle and guide plate assembly 40 is provided including a horizontal guide plate 41 and manifold 42. The manifold has a conduit 43 (FIG. 1) which is connected to a source of pressurized air, with air being admitted from the conduit to the upper surface of the guide plate through openings 44. In order to form the air which flows through the openings 44 into wide horizontal jets parallel to the surface of the guide plate, a nozzle plate 45 is spaced a small distance above the guide plate and separated therefrom by a separator plate 46 which is of comb-like construction having fingers 47 (FIG. 3) and defining openings 48 which are in register with the plate openings 44. Because of the confinement provided by the nozzle plate 45 in the vertical dimension and the fingers 47 in the horizontal dimension, the air in the jets ejects along the guide plate at high velocity, a velocity which may range, for example, between 60 feet per second to a maximum of, say, 600 feet per second.

In accordance with the present invention the surface of the guide plate 41 is formed with a plurality of upraised islands which are spaced from one another over the area of the guide plate, the islands presenting plateau surfaces at approximately the same elevation above the guide plate and against which the arriving sheet is sucked by the action of the horizontal air jets. In the illustrated embodiment the upraised islands are five in number, indicated at 51–51, generally alined with the fingers 47 in the separator plate and defining between them passageways 61–64 which are alined with the individual air jets indicated by the arrows. In the preferred embodiment the islands are not only laterally spaced from one another but are staggered in the direction of the air stream, the islands 51, 53, 55 constituting a first row and the islands 52, 54 a second row.

Since all of the islands have approximately the same height and are substantially flat topped forming plateau surfaces which are frictionally engaged by each passing sheet, the body of the sheet is both decelerated and supported so that the fluttering and whipping found in conventional air-stream retarders cannot occur.

Figure 4:
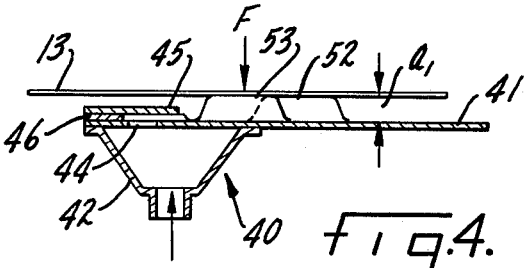
FIG. 4 is a vertical section taken along the line 4—4 in FIG. 3.
Figure 5:
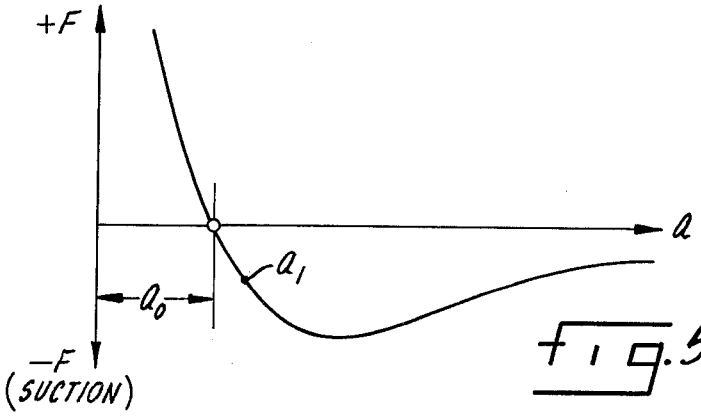
FIG. 5 is a graph showing the force exerted upon a sheet as a function of sheet height.

Our observations show that a sheet which is arranged parallel to a jet stream confined by a guide plate may be either drawn downwardly toward the plate or repelled upwardly from the plate depending upon the height of the sheet from the plate. The variation of positive and negative (sucking) force has been plotted in FIG. 5 as a function of the spacing $a$ of the sheet above the plate. Thus it will be noted that when the sheet is at a level above the plate less than a reference amount $a_0$, the sheet tends to be raised by the jet stream. However, when the sheet is raised above the level $a_0$ the opposite effect occurs, that is, the sheet tends to be sucked downwardly in the direction of the plate. The spacing $a_0$, which is at the transition point between these two conditions, may be referred to as the "neutral" or "floating" level. It has been found that when a sheet is at the "floating" level the effect of the jet stream is to cause the sheet to flutter or whip vigorously to the extent that control of the sheet may be lost. It is, therefore, one of the aspects of the present invention to make the spacing of the plateau surfaces, above the guide plate, an amount greater than the amount $a_0$, so that the traversing sheet will tend to be sucked downwardly by the jet stream against the plateau surfaces with a predetermined force while effectively precluding any possibility of flutter so that the sheet is maintained straight and under complete control. In a practical case the height of the plateau surfaces, which determines the sheet path above the guide plate, and which is indicated at $a_1$ in FIG. 4, may be within the range of 0.2 centimeters to 0.5 centimeters. It is found further that the dimension $a_1$ may be related to the thickness of the jets at the nozzle assembly, the dimension being at least twice the jet thickness.

In any event the plateau height may be empirically determined, for a given design, and for a given nozzle assembly and operating pressure by noting the level at which a sheet tends to float above the guide plate absent the islands, and by forming islands having a plateau height which exceeds the floating height by a safe margin, for example, by a margin of 25 percent or greater. Since the curve at the level $1.25 \times a_0$ (FIG. 5) is sloped, the margin may be adjusted, along with the plateau area, to obtain any desired degree of retarding force.

It is one of the features of the present invention that the plateau surfaces are spaced from one another both laterally and longitudinally as shown in the drawings and it is a further feature of the invention that the total area of the plateau surfaces is substantially less than half of the total area of the guide plate.

As a still further feature of the invention it is preferred to vary the air pressure furnished to the manifold 42 in accordance with the operating speed of the press, that is, in accordance with the speed with which the sheets are delivered. Thus there may be interposed, between the source of pressurized air indicated at 70 (FIG. 6), and the manifold duct 43, a speed responsive throttling valve 71 having a plunger 72. The position of the plunger is controlled by a flyball governor 73 which may be driven by a belt 74 from the press drive 17. The faster the rotation of the drive, the higher the plunger position and the greater the air flow, so that the force acting upon the sheets is increased generally in proportion to press speed. In short, the retarding force and anti-flutter effect are both increased as a function of sheet velocity.

It is a further feature of the invention, in one of its aspects, that the guide plate 41 may be formed into separate portions by means of a U-shaped slit 75. As shown in FIG. 7, the slit separates the guide plate 41 into a frame portion 41*a* and a central portion 41, the latter having a gradual downward curvature away from the sheet. The plate may in addition be bent downwardly to form a skirt 41*c*. The advantage of the structure shown in FIG. 7 is that the thickness of the jet defined between the portion 41*b* of the guide plate and the sheet varies inversely in accordance with the approach of the sheet to the plateaus and to the nozzle structure, so that the sheet is more gradually subjected to the jet forces as it proceeds along the path of conveyance. In addition the frame 41*a* and the skirt 41*c* may contact the trailing portion of the sheet to provide additional retardation and support.

The structure described above effectively carries out the objects of the invention, with the sheet being held, by the plateau surfaces, at a level above the guide plate which is sufficient to develop a well-defined sucking action so that retarding frictional forces are reliably established with no fluttering tendency, the anti-flutter effect being distributed in the longitudinal dimension of the sheet by reason of the longitudinal offset of the islands while the lateral spacing of the islands provides access between them for the jets produced by the successive nozzle openings. The arrangement is found to work particularly efficiently at high speed and for all thicknesses of sheets down to the thinnest normally handled in a lithographic press.

The term plateau as used herein covers any raised region including the use of longitudinal ribs and does not necessarily imply a flat, two dimensional surface.

What we claim is:

1. In a delivery arrangement for a sheet-fed printing press for delivering sheets onto a delivery pile, the combination comprising means for supporting a pile of sheets, a conveyor for conveying sheets by their leading edges longitudinally along a sheet delivery path to a position above the pile, a take-off mechanism at the delivery pile synchronized with the arrival of the sheets for taking the sheets from the conveyor and for decelerating the leading edges thereof for depositing them on the pile, a nozzle assembly including spaced fingers defining a series of nozzles spaced edge to edge in a plane, a source of air under pressure for feeding the nozzle assembly, the nozzle assembly being located adjacent the pile below the level of the approaching sheets and extending along the width of the sheets so that laterally spaced jets of air are directed substantially parallel to the underside of each sheet in a direction upstream of sheet movement, a guide plate spaced under the sheet path and extending from the nozzle assembly in the upstream direction tending to confine the jets of air under an arriving sheet, the surface of the guide plate having formed on the surface thereof a plurality of upraised islands laterally spaced from one another so as to be in respective alinement with the fingers between the jets, the islands presenting plateau surfaces at approximately the same elevation above the guide plate and substantially parallel thereto and extending above the plane of the nozzles so that when the sheet is sucked downwardly by the effect of the jets it is drawn to the plateau surfaces in light frictional engagement to apply frictional drag to the body of the sheet while preventing fluttering thereof.

2. The combination as claimed in claim 1 in which adjacent islands are spaced from one another both laterally and longitudinally of the guide plate.

3. The combination as claimed in claim 1 in which the plateau surfaces are at a constant height above the guide plate which is greater than the neutral height at which a sheet in the absence of the islands would tend to float on the air stream.

4. The combination as claimed in claim 1 in which all portions of the plateau surfaces are at a constant height above the guide plate at least twice as great as the thickness of the jets at the nozzle assembly.

5. The combination as claimed in claim 4 in which the total area of the plateau surfaces is substantially less than half of the total area of the guide plate on which the plateau surfaces are formed.

6. The combination as claimed in claim 1 in which at least a portion of the guide plate is formed with a gradual curvature in a direction downwardly away from the sheet and terminating in a skirt which is bent downwardly at a sharp angle.

7. The combination as claimed in claim 1 in which the nozzle assembly includes a nozzle plate spaced above the guide plate, a manifold arranged below the guide plate, a separator plate interposed between the guide plate and the nozzle plate, the separator plate being integrally formed with laterally spaced fingers respectively alined with the islands, the guide plate having spaced through-openings for feeding air from the manifold to the underside of the nozzle plate between the fingers to define wide nozzles spaced edge to edge to produce jets of air directed between the islands.

* * * * *